United States Patent [19]

Pachmayr et al.

[11] 4,043,066

[45] Aug. 23, 1977

[54] PISTOL GRIP

[75] Inventors: Frank A. Pachmayr, Los Angeles; Jack R. Farrar, Whittier, both of Calif.

[73] Assignee: Pachmayr Gun Works, Inc., Los Angeles, Calif.

[21] Appl. No.: 693,424

[22] Filed: June 7, 1976

[51] Int. Cl.[2] ..... F41C 23/00

[52] U.S. Cl. ..... 42/71 P

[58] Field of Search ..... 42/71 P

[56] References Cited

U.S. PATENT DOCUMENTS

| | | | |
|---|---|---|---|
| 1,049,739 | 1/1913 | Leach, Jr. | 42/71 P |
| 1,279,372 | 9/1918 | Lempie | 42/71 P |
| 1,531,796 | 3/1925 | Loomis | 42/71 P |
| 3,672,084 | 6/1972 | Pachmayr | 42/71 P |
| 3,815,270 | 6/1974 | Pachmayr | 42/71 P |

*Primary Examiner*—Charles T. Jordan
*Attorney, Agent, or Firm*—William P. Green

[57] ABSTRACT

A pistol grip including two side panels to be received at opposite sides of the handle of a pistol, and cross straps to extend between the two side panels at the front and back of the handle, with all of these sections including elastomeric material having outer gripping surfaces to be contacted by the hand of a user, and with the cross straps having connector portions which extend to locations at the inner sides of the side panels and which have projections extending laterally outwardly to positions opposite coacting shoulders formed in the side panels in a relation positively locking the cross straps against detachment from the side panels.

19 Claims, 6 Drawing Figures

PISTOL GRIP

BACKGROUND OF THE INVENTION

This invention relates to improved pistol grips, to be connected to the handle of a pistol for improving the effectiveness and comfort with which a user can hold the gun.

In two prior U.S. Pat. Nos. 3,672,084 and 3,815,270, there have been shown pistol grips consisting of elastomeric material, such as rubber, carried about the handle of a pistol, and containing apertured reinforcing plates embedded within the elastomeric material. In the latter of these patents, Number 3,815,270, the grip structure includes a unitary body of elastomeric material forming two side portions or panels of the grip to be received at opposite sides of the pistol handle, and an intermediate portion of the body extending between and interconnecting the two side portions and adapted to extend across the front of the pistol handle in use. The prior art also includes a commercial embodiment of the invention of U.S. Pat. No. 3,815,270 in which there has been provided, along with the unitary U-shaped structure shown in the patent for covering the sides and front of the gun handle, an additional separately formed rubber piece taking the form of a cross strap adapted to extend across the back side of the gun handle for presenting an elastomeric gripping surface at that location. In this prior art commerical embodiment, the rubber cross strap has edges which extend forwardly at the opposite sides of the gun handle, to be received between the gun handle and edge portions of the side panels of the main U-shaped part. These portions of the cross strap which are received between the side panels and the gun handle have lugs at their inner sides projecting into recesses formed in the side of the gun handle, to hold the cross piece in position.

SUMMARY OF THE INVENTION

A pistol grip constructed in accordance with the present invention includes two side panels having elastomeric bodies and adapted to be received at opposite sides of the pistol handle, and at least on cross strap extending laterally between these two side panels at either the front or back of the gun handle, preferably two such straps at both of those locations. A major feature of novelty of the invention resides in a unique manner in which such a cross strap may be interlocked directly with an edge of one of the side panels to lock the cross strap in place and against separation from the side panel without the necessity for any interlocking relationship between the cross strap and the gun itself. More particularly, the cross strap has an edge portion which extends to a location at the inner side of an edge of a coacting one of the side panels, and which carries at the inner side of that panel a projection extending laterally outwardly in a direction away from the gun handle and into an interfitting relation with respect to the panel. The panel at its inner side forms a shoulder which extends inwardly toward the gun handle and to a position opposite the discussed projection on the edge portion of the cross strap, to positively block movement of the cross strap in a direction to separate it from the side panel. Desirably, connections of this unique type are formed at both sides of each of two front and rear cross straps. At the location of each such projection, the contacted portion of the side panel may contain an essentially vertical groove, into which the lateral projection or rib on the cross strap projects, with a wall of the groove functioning as the blocking shoulder which engages and prevents movement of the projection and attached cross strap.

The portions of the strap units which connect to the side panels may be formed of metal or other material having substantially more rigidity or stiffness than the elastomeric material which forms the bodies of the various parts and which forms the gripping surfaces to be engaged by the hand of a user. These relatively rigid elements may be embedded in the elastomeric material of the cross straps,and project therefrom to positions at the inner sides of the side panels, and may have turned terminal flange portions forming the discussed interlocking projections. In one form of the invention, a single reinforcing plate extends across the entire width of the cross strap, with its opposite edge portions forming the flanged connectors which attach to the opposite side panels.

BRIEF DESCRIPTION OF THE DRAWING

The above and other features and objects of the invention will be better understood from the following detailed description of the typical embodiment illustrated in the accompanying drawing in which.

DESCRIPTION OF THE PREFERRED EMBODIMENTS

Figure 1:
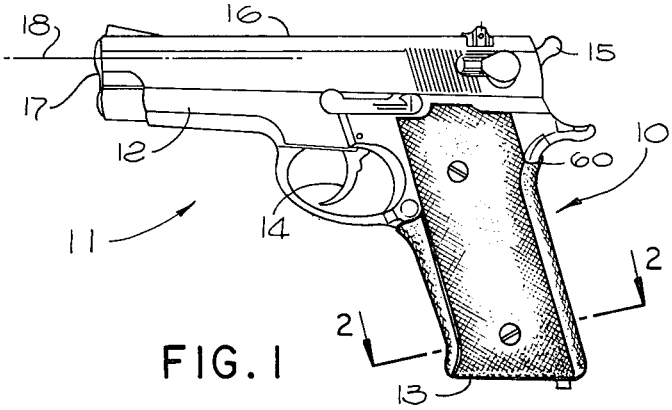
FIG. 1 is a side view of the handle portion of a gun having a grip assembly constructed in accordance with the invention.

Though it will be apparent that certain features of the invention can be applied to pistols of various types, I have typically illustrated a grip assembly 10 embodying the invention which is designed for use on an automatic pistol 11 of a known type having a frame 12 with a downwardly projecting handle portion 13 which is hollow and into which a slide carrying a series of rounds of ammunition is insertable upwardly. The usual trigger 14 controls firing operation of the hammer 15, which is automatically cocked by recoiling movement of a slide 16. The axis of the barrel 17 of the gun is represented at 18 in FIG. 1.

Figure 2:
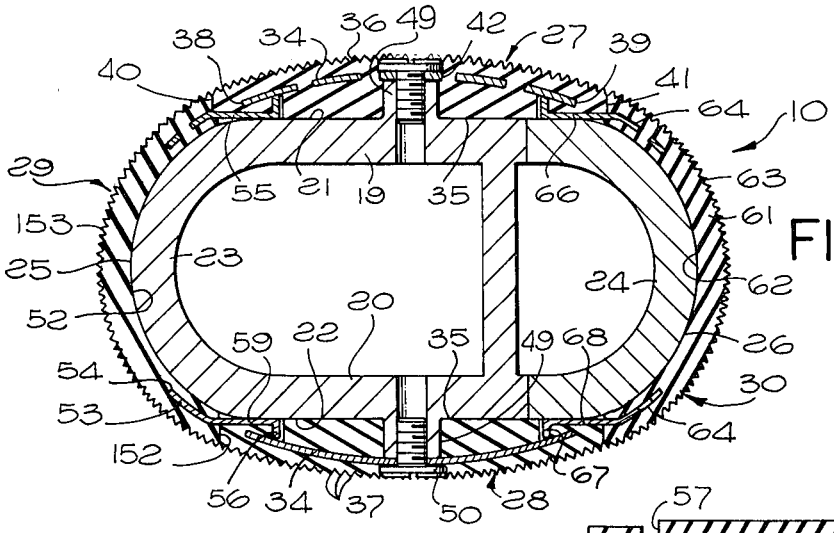
FIG. 2 is an enlarged transverse section through the gun handle and grip, taken on line 2—2 of FIG. 1.

The hollow downwardly projecting handle portion 13 of the gun frame has the cross sectional configuration illustrated in FIG. 2, and more particularly has two parallel opposite side walls 19 and 20 with outer planar parallel side surfaces 21 and 22. The hollow handle is closed at its forward and rear ends by front and rear walls represented at 23 and 24, having curving surfaces 25 and 26 which merge with the side surfaces 21 and 22.

The grip assembly 10 with which the present invention is particularly concerned includes two similar opposite side panels 27 and 28, a forward cross strap 29, and a rear cross strap 30. The two side panels 27 and 28 may be considered as essentially identical to one another, except that each is the mirror image of the other for reception at the opposite side of the handle, and except also for the fact that the upper end 31 of panel 28 may be cut off as illustrated to a slightly different shape than the upper end 32 of panel 27, to properly interfit with and match the external shape of the upper portion of the gun at the side at which panel 28 is located.

Each of the side panels 27 and 28 is formed of a body 33 of elastomeric material, desirably a fairly soft neoprene or other rubber having a Shore hardness typically between about 35 and 55, with a rigid preferably metal reinforcing plate 34 embedded within the rubber body. At its inner side, the elastomeric body of each side panel 27 and 28 has a planar surface 35, which engages and is clamped tightly against a corresponding side surface 21 or 22 of the handle of the gun, with the outer side of the elastomeric body forming a convexly curved outer surface 36 (FIG. 2) which may be irregularized to present a large number of closely spaced small projections 37, desirably of a 'checkered' pattern.

The reinforcing plate 34 may be rigid and stamped of metal to the illustrated configuration, and more particularly preferably has the outwardly convex cross sectional configuration illustrated in FIG. 2 corresponding to and closely following the curvature of the outer surface 36 of the side panel. Along its front and rear edges, the reinforcing plate 34 of each side panel may terminate at edges designated by the numbers 38 and 39 in FIG. 2, closely proximate the corresponding edges 40 and 41 of the elastomeric material itself. To facilitate bonding of each of plates 34 to the rubber within which they are embedded, each plate 34 may contain a number of bonding apertures 42, and may have typically partial circular cut-outs 43 at spaced locations along its edges 38 and 39. The upper edge 44 of each reinforcing plate 34 may extend essentially parallel to and in close proximity to the upper edge 45 of the elastomeric material, and may have an inturned flange 46 extending into proximity to the plane of the inner flat surface 35 of the rubber body. A similar inturned flange 47 may be provided at the lower end of reinforcing plate 34, adjacent the bottom edge 48 of the elastomeric body.

The side walls 19 and 20 of the handle of the gun have vertically spaced externally cylindrical and internally threaded bosses 49 projecting therefrom; into which screws 50 are connectable, through openings in plates 34, to clamp engaged portions of the plates inwardly against the bosses and thereby tightly retain the side panels 27 and 28 on the gun.

Figure 4:
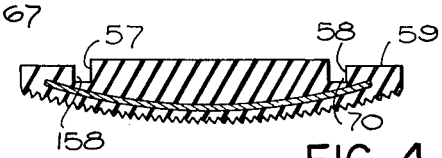
FIG. 4 is a section taken on line 4—4 of FIG. 3.

The front cross strap 29 includes a thin flexible body 51 of elastomeric material, desirably the same rubber of which the main bodies of side panels 27 and 28 are molded, with body 51 having a smooth inner surface 52 engaging front surface 25 of the gun handle. The outer surface 153 of strap 29 may be irregularized by checkering or otherwise in the same manner as discussed in connection with the outer surfaces 36 of the side panels. The opposite side edges 152 of the elastomeric body 51 are desirable essentially straight along most of their vertical extent, and are received in engagement with the corresponding edges of the side panels. Embedded within and bonded to the opposite edge portions of the rubber body 51 of front strap 29 are a pair of connecting elements 53, having the cross section illustrated in FIG. 2. The portions 54 of these elements 53 which are embedded in the rubber may be apertured to facilitate bonding thereto. The portions of elements 53 beyond the rubber have first planar portions 55 which are received adjacent the outer side surfaces 21 and 22 of the gun handle, and terminate in out-turned flanges 56, which are perpendicular to portions 55 and to surfaces 21 and 22. These flanges or projections 56 extend laterally outwardly into vertical grooves 57 formed in the forward portions of side panels 27 and 28. Grooves 57 and 58 may have the square cross sectional configuration illustrated in FIG. 4, so that the front wall 158 of the groove extends directly transversely of the axis of the gun, and therefore of a front to rear direction with respect to the gun, and directly transversely of surfaces 21 and 22 and portion 55 of elements 53. The engagement of flanges 56 formed by the shoulders or walls 58 on the side panels thus blocks forward movement of elements 53 relative to the side panels in a manner positively interlocking the front strap 29 with the side panels and preventing disconnection therefrom. Elements 53 are confined at the inner sides of the side panels, and clamped between those side panels and the side surfaces of the gun handle, with the inner surface of the forward edge portion of each side panel being slightly relieved forwardly of groove 57, so that the short planar surface 59 of each side panel at that location is spaced outwardly with respect to the plane of the main flat inner surface 35 of the side panel a distance corresponding exactly to the thickness of the flat portion 55 of sheet metal part 53, to confine portion 55 of part 53 between the side panel and the gun handle as shown in FIG. 2.

Figure 3:
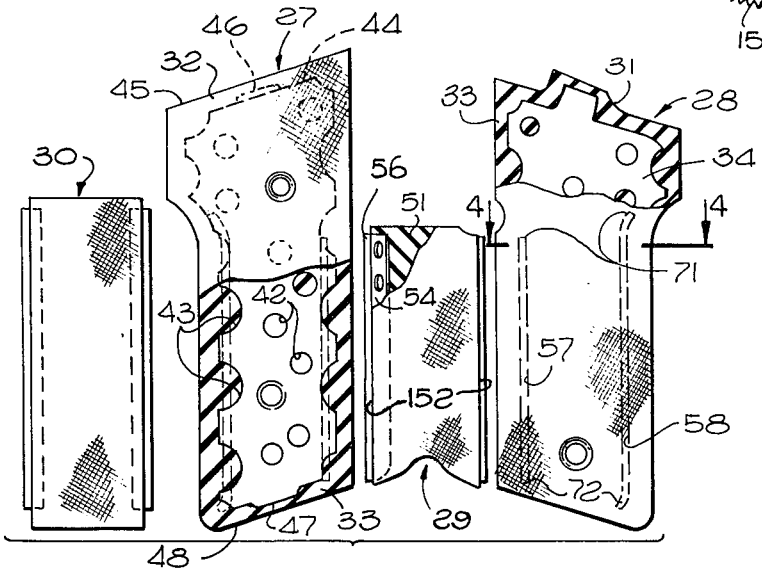
FIG. 3 is a developed view showing the four elements of the grip assembly disconnected and in side by side relation, as they appear in elevation.

The rear cross strap 30 is essentially the same as the above discussed forward strap 29, except as the rear strap may be changed in vertical length and shaped slightly differently to follow the contour of the rear curved surface 26 rather than the forward curved surface 25 of the gun handle. In an assembly designed for the particular type of gun illustrated in FIGS. 1 to 4, the rear cross strap 30 may be of greater vertical height, and may curve rearwardly slightly at its upper end as illustrated in 60 in FIG. 1. As in the case of the front strap, the rear strap has a thin elastomeric body 61, typically of the same type rubber utilized in the other parts 27, 28 and 29, with an inner smooth surface 62 and outer irregularized gripping surface 63, and with two connecting elements 64 embedded in the opposite edge portions of the elastomeric body, and projecting therebeyond to have first flat portions 66 extending along the outer side surfaces of the handle body, and terminal transverse flange portions 67 extending perpendicular to portions 66. The portions 66 are confined between flat surfaces 68 on the forward edge portion of the side panels and the outer planar surfaces 21 and 22 of the handle body, with surfaces 68 being relieved outwardly just sufficient to allow for and receive the thickness of portions 66 of elements 64, and with flanges 67 projecting outwardly into grooves 58 for engagement with transverse shoulder 70 formed at the forward sides of those grooves to block separating movement of the rear strap relative to the side panels in a manner discussed in connection with the interlock between the forward strap and the side panels. The vertical extents of grooves 57 and 58 are illustrated in FIG. 3, in which the upper ends of the grooves are designated 71 and the lower ends are designated 72. The rigid connector elements 53 and 64, including their interlocking flange portions 56 and 67, have this same vertical extent, to fit into and engage the grooves in interlocking relation along the entire vertical distances between the upper and lower ends 71 and 72 of the grooves. In order to fit properly the contour of the rear portion of the gun, the upper end portions of rear grooves 58 may curve rearwardly as illustrated in FIG. 3, and the interfitting flanges 67 may similarly curve rearwardly as they approach their upper ends.

In attaching the various grip elements to the gun handle, a user merely places the front and rear straps in position before tightening the side panels 27 and 28 against the gun by screws 50, so that as the screws are tightened the connector elements 53 and 64 are confined at the inner sides of the front and rear edge portions of the side panels, and the flanges of those elements 53 and 64 are located to project into grooves 57 and 58 to be effectively locked therein and positively retain the front and rear straps in the illustrated positions on the gun. When a user then grasps the gun, his hand engages the irregularized or checkered outer surfaces of the side panels and front and rear straps, with the resilience of the rubber elements serving to cushion the grip and enhance the friction between the hand and grip, thereby improving the manual control which the user has on the gun.

Figure 5:
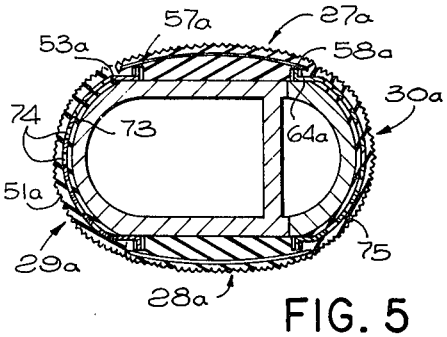
FIG. 5 is a view similar to FIG. 2, but showing a variational form of the invention.

FIG. 5 shows a variational arrangement which may be considered as identical with that of FIG. 2 except with regard to the construction of the front strap 29*a* and rear strap 30*a*. In particular, in FIG. 5, the rigid connecting elements 53*a* of the forward strap (corresponding to elements 53 of FIG. 2) are formed as opposite ends of a single reinforcing plate 73, which is embedded within the rubber body 51*a* of strap 29*a*, and extends across the entire width of that body as shown. Plate 73 contains a number of apertures 74 spaced across the entire area of the plate, so that the rubber material may extend through those apertures and improve the bond between the rubber and plate 73. As in the case of elements 53 and 64, the plate 73 is preferably stamped from sheet metal, and is desirable essentially rigid, to retain the curved configuration illustrated in FIG. 5 and corresponding to the curvature of the forward portion of the gun handle.

The rear strap 30*a* is similarly formed to include a single apertured metal stamping or other reinforcing plate 75, whose opposite edge portions are shaped to form connecting elements 64*a* corresponding to and serving the function of elements 64 of the first form of the invention. The elements or projections 53*a* and 64*a* project into grooves 57*a* and 58*a* in side panels 27*a* and 28*a*, (corresponding to grooves 57 and 58 of the first form), so that tightening of the side plates on the gun of FIG. 5 attains an interlock with the front and rear straps in the same manner as discussed previously, but with the added feature of reinforcement of the front and rear straps by provision of the wide reinforcing plates 73 and 75.

Figure 6:
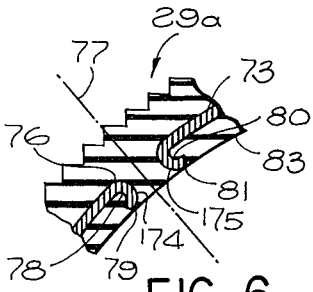
FIG. 6 is an enlarged detailed view of a portion of FIG. 5.

Referring now to FIG. 6, the plates 73 and 75 of FIG. 5 desirably have the configuration illustrated in FIG. 6 at the location of each of the apertures 74 in plates 71 and 73. As seen in FIG. 6, the material of plate 73 which is disposed about and forms each of the apertures 74 is deformed to a configuration forming an eyelet-like annular wall 175 of the aperture, which wall 175 first advances radially inwardly at 76 toward the axis or center 77 of the aperture, then curves axially at 78, and then curves back radially outwardly at 79. This configuration provides an annular radially outwardly facing groove 80 about the aperture, into which groove the elastomeric material of the strap extends in a relation effectively interlocking the rubber with the metal, and assuring against separation of these elements from one another in use. The annular edge 81 formed at the end of each of these eyelet like structures 175 is desirably aligned with the inner surface 83 of the rubber body 51*a* of the strap 29*a* or 30*a*, so that this edge may engage a die section and accurately locate the metal plate relative thereto during a molding operation. Also, these edges can similarly engage the outer surface of the gun handle itself in use to assist in maintaining the straps in properly located position thereon.

While certain specific embodiments of the present invention have been disclosed as typical, the invention is of course not limited to these particular forms, but rather is applicable broadly to all such variations as fall within the scope of the appended claims.

We claim:

1. A pistol grip comprising:

two side panels to be recieved at opposite sides of a pistol handle and each including a boy of elastomeric material having an outer surface to be gripped by a user; and a cross strap adapted to extend laterally between said side panels adjacent the handle and including elastomeric material presenting an exposed gripping surface;

said cross strap having a connector portion which extends to a location at the inner side of one of said panels and which has an interlocking projection extending laterally outwardly away from the pistol handle and toward said one panel;

said one panel having a shoulder at its inner side which extends inwardly toward the pistol handle to a position opposite said projection in generally a front to rear direction and in a relation positively blocking separating movement of said connector portion of the cross strap from said one panel.

2. A pistol grip as recited in claim 1, including fastener means for retaining said side panels on the pistol handle at opposite sides thereof.

3. A pistol grip as recited in claim 1, in which said one panel contains a generally vertical groove at the inner side thereof into which said projection of the cross strap extends, said shoulder being a side wall of said groove.

4. A pistol grip as recited in claim 1, in which said connector portion of said cross strap includes a member which is bonded to and more rigid than the elastomeric material of the cross strap and projects therefrom and has a flange portion turned laterally outward to form said interlocking projection.

5. A pistol grip comprising:

two side panels to be received at opposite sides of a pistol handle and each including a body of elastomeric material having an outer surface to be gripped by a user; and a cross strap adapted to extend laterally between said side panels adjacent the handle and including a body of elastomeric material presenting an exposed gripping surface;

said cross strap having two connector portions near opposite edges thereof which extend to locations at the inner sides of sid two side panels respectively, and which have interlocking projections extending laterally outwardly in generally opposite directions toward said two panels respectively;

each of said panels having a shoulder at its inner side which extends inwardly toward the pistol handle to a position opposite a corresponding one of said interlocking projections in a generally front to rear direction and in a relation positively blocking separating movement of said connector portions of the cross strap from said panels.

6. A pistol grip as recited in claim 5, in which said two connector portions of the cross strap are elements bonded to and more rigid than the elastomeric material of the cross strap and projecting from opposite edges thereof an having flange portions turned laterally outwardly to form said projections.

7. A pistol grip as recited in claim 6, in which said two panels have generally vertical grooves formed in their inner sides into which said flange portions of said elements project in interfitting relation, said shoulders being side walls of said grooves.

8. A pistol grip as recited in claim 5, in which said cross strap includes a reinforcing plate embedded within and bonded to said elastomeric material of the cross strap and having opposite edges forming said connector portions of the cross strap extending to the inner sides of said panels respectively and flanged to form said projections.

9. A pistol grip as recited in claim 8, in which said plate is curved to follow essentially a curved surface of the pistol handle.

10. A pistol grip as recited in claim 5, in which said side panels include apertured reinforcing plates embedded in and bonded to said elastomeric material of the panels.

11. A pistol grip as recited in claim 5, including a reinforcing plate embedded in one of said bodies of elastomeric material and containing apertures through which the elastomeric material extends, the material of said plate about individual ones of said apertures being deformed to first extend generally radially inwardly toward the axis of the aperture, then curve axially, and then curve more radially outwardly to an edge in a relation defining a radially outwardly facing annular groove into which the elastomeric material extends in interlocking relation.

12. A pistol grip as recited in claim 5, in which said cross strap includes a reinforcing plate embedded in the elastomeric material of the cross strap and curved to follow essentially the curvature of an adjacent surface of the pistol handle, and having opposite edge portions projecting beyond the elastomeric material and forming said connector portions of the strap; said reinforcing plate containing apertures through which the elastomeric material extends; the material of said plate about at least some of said apertures being deformed to first extend generally radially inwardly toward the axis of the aperture, then curve generally axially, and then curve more radially outwardly to define a radially outwardly facing groove about the aperture into which the elastomeric material extends in interlocking relation.

13. A pistol grip as recited in claim 5, in which said side panels contain curved inwardly concave apertured reinforcing plates embedded in the elastomeric material of the side panels, there being fasteners connectible to the gun handle through apertures in said panels to secure them to the handle; said connector portions of the cross strap including material more rigid than the elastomeric material of the cross strap and bonded thereto and projecting from opposite sides thereof for reception at the inner sides of edge portions of said two panels respectively, said more rigid material having edges turned outwardly to form said two projections, said elastomeric material of said panels containing generally vertical grooves into which said projections extend in interfitting relation, with side walls of said grooves forming said shoulders.

14. A pistol grip comprising:

two side panels to be received at opposite sides of a pistol handle and each including a body of elastomeric material having an outer surface to be gripped by a user, and an apertured reinforcing plate embedded in the elastomeric material;

fasteners adapted to extend through apertures in said side panels and connect said panels to the pistol handle; and two cross straps formed separately from said two side panels and adapted to extend laterally between said side panels at the front and back respectively of the handle, and each including a body of elastomeric material presenting an exposed gripping surface;

each of said cross straps having two connector portions at its opposite edges which extend to locations at the inner sides of corresponding edge portions of said two side panels respectively;

said connector portions of said cross straps having interlocking projections which extend laterally outwardly away from the pistol handle and toward the corresponding side panels;

said panels having shoulders at their inner sides which extend inwardly toward the pistol handle to positions opposite each of said interlocking projections in a generally front to rear direction and in a relation positively blocking separating movement of each of said connector portions of the cross strap from the panel at whose inner side it is received.

15. A pistol grip as recited in claim 14, in which said connector portions are formed of essentially rigid material embedded in and bonded to the elastomeric material of the cross straps and projecting therefrom for reception at the inner sides of edge portions of said side panels, and turned laterally outwardly at edges of said essentially rigid material to form flanges constituting said projections.

16. A pistol grip as recited in claim 15, in which the elastomeric material of said panels contains grooves extending generally vertically at the inner sides of the panels and into which said projections extend, with side walls of said grooves constituting said shoulder.

17. A pistol grip as recited in claim 16, in which said essentailly rigid material of each of the connector straps constitutes a single piece of such material extending across the entire width of the elastomeric material and having opposite edge portions projecting beyond opposite edges of the elastomeric material to form said connecting portions.

18. A pistol grip comprising:

a body of elastomeric material to be received at the outside of a pistol handle and presenting a gripping surface; an a reinforcing plate embedded in and stiffer than said elastomeric material;

said reinforcing plate containing apertures through which the elastomeric material extends;

the material of said plate about at least someof said apertures being deformed to first extend generally radially inwardly toward the axis of the aperture, then curve generally axially, and then curve generally radially outwardly to an edge in a relation defining an annular radially outwardly facing groove into which the elastomeric material extends in interlocking relation.

19. A pistol grip as recited in claim 18 in which said elastomeric material has an inner surface for engaging the pistol handle in use, and said material of said plate in curving axially about said apertures projects toward said pistol handle and to an edge of said material essentially aligned with said inner surface of the elastomeric material.

* * * * *